US006107245A

United States Patent [19]

Kuga et al.

[11] Patent Number: 6,107,245

[45] Date of Patent: Aug. 22, 2000

[54] THERMAL TRANSFER RECORDING MATERIAL AND RECEIVING MATERIAL THEREOF AND RECORDING METHOD THEREFOR

[75] Inventors: Yutaka Kuga; Hidehiro Mochizuki, both of Numazu; Hiroki Kuboyama, Shizuoka-ken; Shinya Kawahara, Numazu, all of Japan

[73] Assignee: Ricoh Company, Ltd., Tokyo, Japan

[21] Appl. No.: 09/178,243

[22] Filed: Oct. 23, 1998

[30] Foreign Application Priority Data

Oct. 23, 1997 [JP] Japan ..... 9-309354
Oct. 22, 1998 [JP] Japan ..... 10-300933

[51] Int. Cl.[7] ..... B41M 5/035; B41M 5/38

[52] U.S. Cl. ..... 503/227; 428/913; 428/914

[58] Field of Search ..... 8/471; 428/195, 428/913, 914; 503/227

[56] References Cited

U.S. PATENT DOCUMENTS 5,916,842 6/1999 Morimitsu et al. ..... 503/227

*Primary Examiner*—Bruce H. Hess
*Attorney, Agent, or Firm*—Cooper & Dunham LLP

[57] ABSTRACT

A sublimation thermal transfer recording material including a substrate and one or more ink layers formed on one side of the substrate and including at least a yellow sublimable dye, a magenta sublimable dye and a cyan sublimable dye to form at least a black color image on a receiving material, wherein the magenta and the cyan sublimable dye have better light resistance than the yellow sublimable dye.

18 Claims, No Drawings

THERMAL TRANSFER RECORDING MATERIAL AND RECEIVING MATERIAL THEREOF AND RECORDING METHOD THEREFOR

BACKGROUND OF THE INVENTION

1. Field of the Invention

The present invention relates to a thermal transfer recording material, a thermal transfer receiving material and a thermal transfer recording method therefor, and more particularly to a sublimation thermal transfer recording material and a sublimation thermal transfer receiving material which can produce images having good resistance to light, and to a sublimation thermal transfer recording method therefor.

2. Discussion of the Related Art

In sublimation thermal transfer color recording, black color images can be formed by overlapping, for example, a yellow, a magenta and a cyan color image using three color (yellow, magenta and cyan) recording materials or a recording material in which at least three color ink layers are regularly formed on one side of a substrate. Otherwise a black color recording material is employed to form black images. These color recording materials include one or more sublimable dyes in each ink layer. However, there is no single black sublimable dye, and therefore, for example, a yellow, a magenta, and a cyan color sublimation dyes are mixed to prepare a mixed black sublimation dye. In order to obtain black images having good light resistance, each color sublimable dye preferably has good light resistance. Sublimable dyes preferably are required to have good thermosensitivity, good color properties and good light resistance; however there is no dye which has all of these properties. In general, the properties of thermosensitivity and color properties have higher priority than light resistance when selecting sublimation dyes for recording materials. Therefore, black color images generally have poor light resistance. In addition, it has not been researched as to what color sublimable dye the light resistance of resultant black images mainly depends on.

Because of these reasons, a need exists for black images which can be produced with low heat energy by sublimation thermal transfer recording and which have good image qualities and good light resistance.

SUMMARY OF THE INVENTION

Accordingly, an object of the present invention is to provide one or more sublimation thermal transfer recording materials which include at least a yellow dye, a magenta dye and a cyan dye and which can produce black images having good image qualities and good light resistance with low heat energy.

Another object of the present invention is to provide a sublimation thermal transfer receiving material which can produce black images having good light resistance.

Yet another object of the present invention is to provide a sublimation thermal transfer recording method in which black images having good light resistance can be formed.

To achieve such objects, the present invention contemplates the provision of a sublimation thermal transfer recording material which includes a substrate and one or more ink layers which are formed on one side of the substrate and which include at least a yellow sublimable dye, a magenta sublimable dye and a cyan sublimable dye to form at least a black image on a receiving material, wherein the magenta dye and the cyan dye have better light resistance than the yellow dye.

The sublimation thermal transfer recording material may include a black ink layer including at least a yellow dye, a magenta dye and a cyan dye, or it may include a yellow ink layer, a magenta ink layer and a cyan ink layer which are regularly formed (i.e. side by side) on one surface of the recording material. Three recording materials can also be used in which a yellow ink layer, a magenta ink layer and a cyan ink layer are respectively formed on the three recording materials.

Preferably the cyan sublimable dye includes at least an indoaniline type dye and an anthraquinone type dye, and the magenta sublimable dye preferably includes at least an azo dye and an anthraquinone dye.

In another aspect of the present invention, a sublimation thermal transfer receiving material is provided which includes a receiving layer which preferably includes an ultraviolet absorbing agent in an upper part thereof. Alternatively, the receiving material may include a protective layer which is formed on a receiving layer and which includes an ultraviolet absorbing agent.

In yet another aspect of the present invention, a sublimation thermal transfer recording method is provided which includes the steps of:

providing a sublimation thermal transfer recording material which includes a substrate and one or plural ink layers formed on the substrate and including at least a yellow dye, a magenta dye and a cyan dye to form at least a black image, and a sublimation thermal transfer receiving material including a receiving layer which preferably includes an ultraviolet absorbing agent in the upper part thereof or on which a protective layer comprising an ultraviolet absorbing agent is formed;

imagewise heating the recording material, which is overlaid on the receiving material such that the one ink layer or one of the plural ink layers contacts the receiving layer and, if plural layers are present, repeating the imagewise heating using the other ink layer or layers one by one, to form at least a black image on the receiving layer;

separating the receiving material from the recording material; and then heating the receiving material to diffuse the black dye image into the receiving layer such that the dye image is substantially placed below (inwardly of) the ultraviolet absorbing agent.

Preferably the imagewise heating is performed using an n-fold multiple sublimation thermal transfer recording method.

These and other objects, features and advantages of the present invention will become apparent upon consideration of the following description of the preferred embodiments of the present invention.

DESCRIPTION OF THE PREFERRED EMBODIMENTS

In sublimation thermal transfer recording, a black color image is obtained, for example, by overprinting a yellow image, a magenta image and a cyan image using a recording material including a yellow ink layer, a magenta ink layer and a cyan ink layer or using three color recording materials each of which includes one of a yellow, a magenta, and a cyan ink layer, or by recording a black image using a black color recording material in which a black ink layer including, for example, a yellow, a magenta and a cyan dye is formed.

In order to obtain images having good image density, a dye having high absorbance is preferably used because high image density can be obtained with a small amount of the dye. However, a dye having high absorbance generally has poor light resistance. Therefore it is difficult to obtain a recording material which can produce a black image having good image density and good light resistance at low recording energy, i.e., in a small amount of a transferred dye.

In general, black color images absorb light in a range of from 440 nm to 700 nm. Yellow dyes have light absorbing properties in which the absorbance has almost the normal distribution curve in a range of wave length of from 400 to 500 nm and its peak value is about 450 nm. Magenta dyes have light absorbing properties in which the absorbance has almost the normal distribution curve in a range of from 500 to 600 nm and its peak value is about 550 nm. Cyan dyes have light absorbing properties in which the absorbance has almost the normal distribution curve in a range of from 600 to 700 nm and its peak value is about 650 nm. The present inventors have now discovered that the sensitivity of human eyes to yellow colors is lower than that to magenta or cyan colors. Namely, it is discovered that yellow color dyes hardly contribute to the image density of black images. In other words, the light resistance of the black images is hardly affected by the yellow dyes. In addition, it is discovered that a yellowish black image is not preferable because human eyes see it as faded.

Cyan dyes and magenta dyes do not have such light absorbing properties having a normal distribution curve in fact. Cyan dyes generally have a magenta component and a yellow component, and magenta dyes generally have a yellow component. When these dyes are used in an ink layer or layers of a recording material, the light resistance of the cyan dye largely affects the resistance of the resultant black images. When a magenta dye having a violet like color (i.e., a yellow component and a cyan component) and/or a cyan dye having a greenish color (i.e., a yellow component) are used in an ink layer or ink layers of a recording material to form a black image, the light resistance of the magenta dye largely affects the light resistance of the resultant black images. This is because the light absorbing properties of the magenta dye are similar to those of the black images.

From our researches mentioned above, it is discovered that the thermosensitivity and the light resistance of black images can be effectively improved by making magenta and/or cyan dyes used have good thermosensitivity and good light resistance.

In the present invention, the light resistance of a dye is defined as the image density remaining rate after an image formed by the dye is subjected to a light irradiation test. In detailed description, the light irradiation test is that an image having image density of about 1.0 is irradiated with light, which is radiated from a xenon lamp and which has a continuous spectrum, for a predetermined time. The image density remaining rate is determined as follows:

$$\text{Image density remaining rate}=(Ia/Ib)\times 100$$

wherein Ia represents the image density after the image is subjected to a light irradiation test and Ib represents the image density of the image before the light irradiation test.

The light used for determination of the image density remaining rate may be properly modified by filtering the light radiated from a xenon lamp using a filter, for example, to obtain light similar to sunlight or the like. In addition, the irradiation time may be freely changed.

The recording material of the present invention has a substrate and an ink layer or layers which are formed on one side of the substrate and each of which includes at least a sublimable dye.

Suitable substrates for use in the recording material of the present invention include films of resins such as polyester resins, polysulfone resins, polystyrene resins, polycarbonate resins, cellophane, polyamide resins, polyimide resins, polyarylate resins, and polyethylene naphthalate resins. The thickness of the substrate is preferably from about 0.5 to about 20 μm, and more preferably from about 3 to about 10 μm. The substrate may have a heat resistant layer on the opposite side of the ink layer, and an undercoat layer which is formed between the ink layer and the substrate and which improves the adhesion of the substrate and the ink layer. The substrate may be subjected to corona charge treatment.

Specific examples of the sublimable dyes for use in the ink layer include but are not limited to:

C.I. Disperse Yellows 1, 3, 8, 9, 16, 41, 54, 60, 77 and 116;
C.I. Disperse Reds 1, 4, 6, 11, 15, 17, 55, 59, 60, 73 and 83;
C.I. Disperse Blues 3, 14, 19, 26, 56, 60, 64, 72, 99 and 108;
C.I. Solvent Yellows 77 and 116;
C.I. Solvent Reds 23, 25 and 27; and
C.I. Solvent Blues 36, 63, 83 and 105.

These sublimable dyes are employed alone or in combination.

In addition, suitable cyan dyes for use in the present invention include indoaniline type dyes which have good thermosensitivity and color properties. Indoaniline dyes have been disclosed in, for example, Japanese Laid-Open Patent Publications Nos. 61-22993, 61-35994, 61-49893, 61-57651, 61-148269, 61-235190, 60-239289, 61-268493 and 61-31467. Specific examples of such indoaniline dyes include HSO144 and HSO271, which are manufactured by Mitsui Toatsu Dye Chemical Inc.; and HSB2207 and HSB2115, which are manufactured by Mitsubishi Chemical Corp. Further, anthraquinone dyes can also be used as cyan dyes because of having good light resistance. Such anthraquinone dyes have been disclosed in, for example, Japanese Laid-Open Patent Publications Nos. 60-151097, 60-53563, 61-57391, 59-227948, 60-131294, 60-131292, 62-138291, 60-122192, 61-284489, 60-172591 and 61-193887. Specific examples of such anthraquinone dyes include TMR-EBLE, TMR-B-50 and KAYASET BLUE 136, which are manufactured by Nippon Kayaku Co., Ltd. A combination of an indoaniline dye with an anthraquinone dye is preferable because the resultant recording material has good thermosensitivity, and the resultant images have good color properties and good light resistance. The mixing ratio of indoaniline dyes to anthraquinone dyes, which depends on the purposes of the resultant recording material, is preferably from 0.5/9.5 to 9.5/0.5 to maintain the good properties mentioned above.

Suitable magenta dyes for use in the present invention include azo type dyes which have good thermosensitivity and color properties. Azo dyes have been disclosed in, for example, Japanese Laid-Open Patent Publications Nos. 60-30394, 62-32147, 61-12392, 60-30392, 61-227091, 60-30391, 61-227092 and 62-99195. Specific examples of such azo dyes include SMS-5, 7, 8, 9, 10, 11, 12 and 13, which are manufactured by Nippon Kayaku Co., Ltd.; HM-1041 which is manufactured by Mitsui Toatsu Dye Chemical Inc.; and BAYSCRIPT Special Red T, which is manufactured by Bayer Ltd. In addition, anthraquinone dyes can also be used as magenta dyes because of having good light resistance. Such anthraquinone dyes have been disclosed in, for example, Japanese Laid-Open Patent Publications Nos. 61-262190, 60-253595, 60-159091, 60-122192, 60-131293, 61-227093, 62-25092 and 62-97886. Specific examples of such anthraquinone dyes include TM-1450, HSO-147 and EX-90, which are manufactured by Mitsui Toatsu Dye Chemical Inc.; and Red Violet R manufactured by Bayer Ltd. A combination of an azo dye with an anthraquinone dye is preferable because the resultant recording material has good thermosensitivity, and the resultant images have good color properties and good light resistance. The mixing ratio of the azo dyes to anthraquinone dyes, which depends on the purposes of the resultant recording material, is preferably from about 0.5/9.5 to about 9.5/0.5 to maintain the good properties mentioned above.

Suitable binder resins for use in the ink layer of the recording material of the present invention include thermoplastic resins such as polyvinyl chloride resins, polyamide resins, polycarbonate resins, polystyrene resins, acrylic resins, phenolic resins, polyester resins, epoxy resins, fluorine-containing resins, polyvinyl acetal resins and cellulose resins. These resins are employed alone or in combination. Among these resins,polyvinyl acetal resins and polyvinyl acetal resins are preferable because of having good solubility in organic solvents, which are used for an ink layer coating liquid, and good adhesion to the substrate of the recording material. More preferably, polyvinyl acetal resins such as polyvinyl acetoacetal and polyvinyl butyral are used as a binder resin of the ink layer.

Suitable solvents for use in the ink layer coating liquid, which can dissolve or disperse the above-mentioned sublimable dye and the binder resin, include known solvents such as alcohol type solvents, e.g., methanol, ethanol, isopropyl alcohol, butanol and isobutanol; ketone type solvents such as methyl ethyl ketone, methyl isobutyl ketone and cyclohexanone; aromatic solvents such as toluene and xylene; halogen-containing solvents such as dichloromethane and trichloroethane; dioxane; tetrahydrofuran; formamide; dimethylformamide; and dimethylsulfoxide. These solvents are employed alone or in combination. The solvents for use in the ink layer coating liquid are generally selected so as to dissolve the sublimable dye and the binder resin employed for the ink layer in a high solid content. Toluene and methyl ethyl ketone are preferable because of having good evaporation speed and good ability to dissolve binder resins and sublimable dyes, and being relatively inexpensive.

The ink layer of the recording material of the present invention may be single layer type or overlaid multi-layer type. The ink layer is typically coated by gravure coating. When an ink layer is unevenly formed by gravure coating, two-layer coating, i.e., two-time coating, is preferably performed. In this case, the lower layer preferably has a higher dye content and/or a larger dye diffusion coefficient than does the upper layer because the resultant recording materials, which are useful for one-time recording, have good preservability and high thermosensitivity, and the resultant recording materials useful for multiple recording can maintain good image qualities when repeatedly used many times.

The dye content in a single ink layer is from about 20 to about 80% by weight, and preferably from about 25 to about 75% by weight. In addition, the dye in the single ink layer is preferably dispersed in the ink layer in a monomolecular state to produce images having good evenness with relatively low heat energy. The thickness of the single ink layer is from about 0.1 to about 20 $\mu$m, and preferably from about 0.5 to about 2 $\mu$m.

The dye content in the upper layer of a multi-layer type ink layer is generally less than about 80% by weight, and preferably less than about 60% by weight. There is no problem if the upper ink layer includes no dye. When the upper ink layer includes a dye, the dye is preferably dispersed in the ink layer in a monomolecular state to produce images having good evenness with relatively low heat energy. The thickness of the upper ink layer is from about 0.05 to about 5 $\mu$m, and preferably from about 0.1 to about 2 $\mu$m.

The content of the sublimable dye in the lower ink layer, which depends on whether the recording material is to be applied for one-time recording or multiple recording, is generally less than about 80%, and preferably less than about 70% by weight in the lower ink layer of the recording material for one-time recording. In the recording material for one-time recording, the dye content ratio, Q, of the content of the sublimable dye in the lower ink layer to the content of the sublimable dye in the upper ink layer is greater than 1 and not greater than 5, and preferably greater than 1 and not greater than 3. The sublimable dye is preferably dispersed in a monomolecular state in the lower ink layer of the recording material for one-time recording to produce images having good evenness with relatively low heat energy. The thickness of the lower ink layer of the recording material for one-time recording is generally from about 0.05 to about 5 $\mu$m, and preferably from about 0.1 to about 2 $\mu$m.

In the recording material for multiple recording, the content of the sublimable dye in the lower ink layer is generally less than about 90%, and preferably less than 86%. The dye content ratio, Q, is generally greater than 1 and not greater than 10, and preferably not less than about 1.5 and not greater than about 5 to maintain good image qualities in large-n-fold speed mode multiple recording. The sublimable dye is preferably dispersed in the lower ink layer in a state, in which monomolecular dyes and particulate dyes are mixed, to keep the tint of the recorded images constant and to maintain good image qualities without unevenness even in large-n-fold speed mode multiple recording. The thickness of the lower ink layer of the recording material for multiple recording is generally from about 0.1 to about 20 $\mu$m, and preferably from about 0.5 to about 10 $\mu$m.

In order to obtain a large diffusion coefficient in the lower ink layer, a resin or a wax which has a relatively low softening point and/or a relatively low glass transition temperature is preferably included in the lower ink layer in an amount of from about 1 to about 90% by weight of the binder resin in the lower ink layer.

The sublimation thermal transfer receiving material includes a substrate and a receiving layer which preferably includes an ultraviolet absorbing agent or on which a protective layer including an ultraviolet absorbing agent is formed.

Suitable substrates for use in the receiving material of the present invention include papers such as paper, synthetic paper, art paper, coated paper and cellulose fiber paper; and films such as polyolefin films, polyethylene terephthalate films and polycarbonate films. In addition, white opaque films in which one or more white pigments and fillers are included in resin films, or porous resin films can be employed as the substrate. Further, complex sheets in which the sheets and films mentioned above are laminated with each other can also be employed. Specific examples of such complex sheets include complex sheets of cellulose fiber paper/synthetic paper, cellulose fiber paper/resin film, and resin film/synthetic paper. The thickness of the substrate is generally from about 10 to 300 $\mu$m. The substrate may be subjected to primer coating and/or corona charging treatment.

Suitable materials for use in the receiving layer include known resins which can be dyed with sublimable dyes. Specific examples of such resins include polyolefins such as polypropylene; halogenated polymers such as polyvinyl chloride and polyvinylidene chloride; vinyl polymers such as polyvinyl acetate and polyacrylates; polyester resins such as polyethylene terephthalate and polybutylene terephthalate; polystyrene resins; polyamide resins; cellulose resins; and polycarbonate resins. Among these resins, vinyl polymers, polycarbonate resins and polyester resins are preferable.

The receiving layer may include auxiliary agents such as modified or unmodified silicone oils; releasing agents such as fluorine-containing compounds; pigments such as titanium oxide, zinc oxide, calcium carbonate, silica or the like; ultraviolet absorbing agents; and antioxidants.

The thickness of the receiving layer is from about 1 to about 50 μm, and preferably from about 2 to about 5 μm.

The receiving layer of the receiving material of the present invention preferably includes at least one of an antioxidant and a photostabilizer in the receiving layer, i.e., near dye images formed in the receiving layer, to prevent the dye images from coloring or fading. An ultraviolet absorbing agent is preferably included in an upper part of the receiving layer to prevent the dye in the receiving layer from being irradiated with ultraviolet light. More preferably, a protective layer through which dye images can penetrate and which includes an ultraviolet absorbing agent is preferably formed on the receiving layer. The preferred total content of an antioxidant, a photostabilizer and an ultraviolet absorbing agent is from about 0.05 to about 30 parts by weight per 100 parts of total weight of resins in the receiving layer to maintain good whiteness of the receiving layer and preservability of dye images. If a protective layer including an ultraviolet absorbing agent is formed on the receiving layer, an ultraviolet absorbing agent is not necessarily included in the receiving layer.

Specific examples of an antioxidant for use in the receiving layer include an amine type antioxidant such as, N, N'-diphenyl-1, 4-phenylenediamine and phenyl-β-naphthylamine; phenol type antioxidants such as, 2, 6-di-t-butyl-β-cresol, 4, 4'-butylidene-bis (3-methyl-6-butylphenol) and tetrakis[methylene-3-(3', 5'-di-t-butyl-4'-hydroxyphenyl) propionate]; sulfur-containing antioxidants such as, 2-mercaptobenzothiazole and distearylthiodipropionate; hydroquinone type antioxidants such as, 2, 5-di-t-butyl-hydroquinone; and guanidine derivatives such as, 1, 3-dicyclohexyl-2-(2', 5'-dichlorophenyl)guanidine.

Suitable photostabilizers for use in the receiving layer include hindered amines and hindered phenols. Tertiary amine type photostabilizers are preferable because they do not react with an isocyanate compound to be used for the receiving layer. Specific examples of the tertiary amine type photostabilizer include Adekastab LA-82 and Adekaarcles DN-44M which are manufactured by Asahi Denka Kogyo K.K. and Sanol LS-765 which is manufactured by Sankyo Co., Ltd.

Suitable ultraviolet absorbing agents for use in the receiving layer include known ultraviolet absorbing agents such as, hydroxybenzophenone, dihydroxybenzophenone, benzotriazole, hindered amine and salicylate derivatives. Specific examples of such ultraviolet absorbing agents include Tinuvin P (manufactured by Ciba Geigy Ltd.), 2-hydroxy-4-methoxybenzophenone, 2-hydroxy-4-octoxybenzophenone, 2-(2'-hydroxy-3', 5'-di-t-butylphenyl)-5-chlorobenzotriazole, 2-(2-hydroxy-3, 5-di-t-butylphenyl)-2H-benzotriazole and 2-(2'-hydroxy-3'-t-butyl-5'-methylphenyl)-5-chlorobenzotriazole.

Suitable resins for use in the protective layer of the receiving material of the present invention include the resins which are described for use in the receiving layer, fluorine-containing resins and silicone resins. Since resins for use in the protective layer preferably have a poorer ability to be dyed with sublimation dyes than the resins for use in the receiving layer, aromatic polyester resins, styrene-butadiene resins, polyvinyl acetate resins, and polyamide resins are preferable, and, further, methacrylate resins and their copolymers, styrene-maleic acid ester copolymers, polyimide resins, silicone resins, styrene-acrylonitrile resins and polysulfone resins are more preferable. The thickness of the protective layer is preferably from about 0.1 to about 2 μm, and more preferably from about 0.3 to about 1 μm, to receive images with relatively low heat energy.

Since the protective layer is the uppermost layer of the receiving material, the protective layer preferably includes a releasing agent which is mentioned above for use in the receiving layer.

The light resistance of the recorded images can be improved by diffusing dye images, which are formed on the surface of the protective layer when transferred from the recording material, into the inside (interior) of the receiving layer because the dye images are prevented from contacting oxygen in the air. The diffusion of the dye images can be performed by heating the receiving material. This heat treatment can be performed at a temperature of from about 80 to about 200° C. with a heat roller, a ceramic heater, an infrared lamp, an iron or the like for a time from about 0.1 to about 30 seconds, and preferably from about 0.1 to about 5 seconds, to exert good heating effects and to prevent the receiving material from curling.

The heat treatment can be performed with a thermal printhead. Suitable heating in the heat treatment with a thermal printhead is to heat the entire surface of dye images by applying heat energy not greater than the heat energy which can record images having maximum image density. The receiving material may be heated with a thermal printhead by heating from the back side of the recording material which includes a layer having no ink (no dye), i.e., heating from the back side of a no-ink area of the recording material. Namely, for example, a recording material in which a yellow ink, a magenta ink, a cyan ink and a no-ink area are regularly formed (i.e., side by side, in succession) on one surface of a substrate in a longitudinal direction is prepared and a color image is formed with a thermal printhead on a receiving material by imagewise heating from the back side of the yellow, magenta and cyan ink areas. Then the resultant dye images are heated with the thermal printhead by heating from the back side of the no-ink area of the recording material to heat the entire surface of the image and to obtain images having good light resistance. The no-ink area may be a lubricating layer including a lubricant such as silicone resins, waxes and the like. In addition, the no-ink area may be formed with a transparent ink layer (to be transferred onto an image) which includes, for example, a resin, a wax and the like, and which may include an ultraviolet absorbing agent. This method is preferable because images having good light resistance can be easily obtained without providing an additional heater for the image forming apparatus and with hardly increasing the manufacturing cost of the recording material.

Of course the images on the receiving material may be heated with a thermal printhead with or without a sheet therebetween.

The sublimation thermal transfer recording in the present invention is preferably performed by a multiple sublimation thermal recording methods to save running cost of recorded images. Multiple sublimation thermal transfer recording methods are classified as follows:

(1) a recording method in which an image is formed on a receiving material using a one-time recording method but the recording material is repeatedly used n-times (hereinafter referred to as an n-time mode multiple recording method); and (2) a recording method in which an image is formed on a receiving material while the recording material is fed at a speed of 1/n that of the receiving material (hereinafter referred to as an n-fold speed mode multiple recording method).

The image recorded by the n-fold speed mode multiple recording method is superior to the image recorded by the n-time mode multiple recording method because of having advantages in that the recorded images have good evenness and the recording material hardly generates wrinkles during the image recording process.

When a recording material and a receiving material used for one-time recording or n-time mode multiple recording are used for n-fold speed mode multiple recording, the following problem tends to occur:

(1) the recording material and the receiving material are caused to perfectly adhere to each other by the heat for recording images, resulting in occurrence of transfer of the ink layer to the receiving material; or (2) the recording material and the receiving material adhere to each other for a moment, resulting in occurrence of an undesirable horizontal white line in a recorded image.

The recording material useful for n-fold speed mode multiple recording is described hereinafter.

The ink layer of the recording material for use in n-fold speed mode multiple recording preferably includes a lower ink layer (referred to as a dye supplying layer) and an upper ink layer (referred to as a dye transferring layer). A "lower" layer is closer to the substrate than an "upper" layer. The dye supplying layer preferably includes precipitated sublimable dye particles to obtain good evenness of the image density of the recorded images. The term "precipitated particles" means sublimable dye particles which are precipitated out of a coated dye supplying layer coating liquid including a binder resin, a sublimable dye and a solvent during a drying step. Therefore, the amount and the particle size of the precipitated dye particles change mainly depending on the solvent used. Presence of the sublimable dye particles in a dye supplying layer can be easily observed by an electron microscope. The particle size of the sublimable dye particle (which depends on the thickness of the dye supplying layer) is about 0.01 to about 20 $\mu$m, and preferably from about 1 to about 5 $\mu$m. Since the sublimable dye in the ink layer is particulate, such a problem as crystallization of the sublimable dye does not occur during preservation of the recording material.

To form an ink layer including sublimable dye particles, a solvent which dissolves the sublimable dye particles as little as possible is preferably included in the ink layer coating liquid. Specific examples of such a solvent include alcohol type solvents and solvents including a hydroxide group such as glycol ethers.

In addition, the ink layer preferably includes an upper layer, i.e., a dye transferring layer, which is disclosed, for example, in Japanese Laid-Open Patent Publication No. 5-64980, and which is formed on the dye supplying layer.

The dye transferability of the dye transferring layer is preferably less than that of the dye supplying layer. Comparison of dye transferability is carried out by the following methods:

(1) a dye supplying layer coating liquid and a dye transferring layer coating liquid are respectively coated on two sheets made of the same substrate and dried to form two sheets of single-ink-layer type recording materials so that the coating weight of the dye supplying layer is the same as that of the dye transferring;

(2) each of the prepared recording materials is superimposed on a respective sheet of the same receiving material so that the coated surface of each recording material contacts the receiving layer of the receiving material, and heat is applied from the back side of each recording material, namely, heat is applied from the side of the substrate opposed to the ink layer, to record an image on the receiving layer; and (3) the image density of each recorded image is measured, and the recording material having the higher image density has higher dye transferability.

According to our investigation, the quantity of a diffused dye in an ink layer can be represented by the following Fick's law:

$$dn=-D\cdot(dc/dx)\cdot q\cdot dt$$

wherein dn represents the quantity of dye diffused during time dt, q represents the cross section into which the dye quantity diffuses, (dc/dx) represents the gradient of the diffused dye concentration, and D represents the average diffusion coefficient in the ink layer when heat is applied.

It will be understood from the above-mentioned equation that the ways to effectively supply a dye from a dye supplying layer to a dye transferring layer are as follows:

(1) the dye concentration in the dye supplying layer is higher than that in the dye transferring layer; and/or (2) the diffusion coefficient of the dye supplying layer is greater than that of the dye transferring layer.

Suitable binder resins for use in the dye transferring layer include known thermoplastic resins and thermosetting resins. Specific examples of such resins include polyvinyl chloride resins, polyvinyl acetate resins, polyamide resins, polyethylene resins, polycarbonate resins, polypropylene resins, acrylic resins, polyester resins, polyurethane resins, epoxy resins, silicone resins, fluorine-containing resins, polyvinyl acetal resins, polyvinyl alcohol resins, cellulose resins, natural rubbers, synthetic rubbers and copolymers thereof. These resins are employed alone or in combination.

In order to make the dye transferring layer strongly adhere to the dye supplying layer, the dye transferring layer preferably includes a binder resin which has good compatibility with the binder resin in the dye supplying layer. More preferably, the dye transferring layer preferably includes a binder resin which is the same type of resin as the binder resin included in the dye supplying layer.

When the binder resin in the dye transferring layer has active hydrogen, the binder resin can be reacted with an isocyanate compound to make the dye transferring layer more resistant to heat, and thereby an image having good evenness can be obtained without occurrence of a sticking problem.

Specific examples of such an isocyanate compound include aromatic isocyanate compounds such as tolylene diisocyanate, 4, 4-diphenylmethane diisocyanate, triphenylmethane triisocyanate, adducts of tolylene diisocyanate and trimethylolpropane, and trimer of tolylene diisocyanate; aliphatic isocyanate compounds or alicyclic isocyanate compounds such as hexamethylene diisocyanate, dicyclohexylmethane diisocyanate, isophorone diisocyanate, trimethylhexamethylene diisocyanate, 1, 6, 11-undecane triisocyanate, lysine diisocyanate, lysine ester triisocyanate, 1, 8-diisocyanate-4-isocyanatemethyloctane, 1, 3, 6-hexamethylene triisocyanate, bicycloheptane triisocyanate; and derivatives or modified compounds of these compounds.

Specific examples of the preferable isocyanate compounds include Takenate D-102, D-103, D-104, D-103H, D-104N, D-106N, D-110N, D-120N, D-202, D-204, D-215, D-217, D-212M6, D-165NCX, D-170N, D-181N, Staphyloid TDH103, 113 and 703 which are manufactured by Takeda Chemical Industries Inc.

An isocyanate compound and a binder resin are preferably mixed so that the molar ratio of isocyanate groups included in the isocyanate compound to active hydrogen included in the resin is from about 0.1/1 to about 10/1, and more preferably from about 0.3/1 to about 0.7/1.

In addition, the isocyanate compound preferably has a small reaction rate in a reaction with the binder resin to obtain a dye transferring layer coating liquid having a long pot life, particularly when an aliphatic isocyanate is used for a dye transferring layer coating liquid including an alcohol solvent.

The ink layer preferably includes a resin layer having relatively low dye receivability on the top of the ink layer to avoid occurrence of a ghost image when two or more color images are recorded one by one on the same area of the receiving material to obtain a full color image. Suitable resins (for use in the resin layer) having relatively low dye receivability include aromatic polyester resins, styrene-butadiene copolymers, polyvinyl acetate resins and polyamide resins, and preferably include methacrylic resins or copolymers thereof, styrene-maleic acid ester copolymers, polyimide resins, silicone resins, styrene-acrylonitrile copolymers and polysulfone resins. The thickness of the resin layer having relatively low dye receivability is about equal to that of the dye transferring layer. The resin layer having relatively low dye receivability, the dye transferring layer and the dye supplying layer may include known additives such as releasing agents, antioxidants or the like.

Dye receivability of a resin is measured as follows:

(1) preparing a coating liquid by mixing a resin solution having a solid content of 5 to 20% by weight and a silicone oil which is a mixture of SF8417 and SF8411 (both of which are manufactured by Toray Silicone Industries Inc.) mixed in a ratio of 1/1 so that the ratio of the silicone oil to the solid of the resin is 0.3;

(2) coating the coating liquid on a sheet of synthetic paper, Yupo FPG#95 manufactured by Oji Yuka Synthetic Paper Co., Ltd., and drying the coated liquid for 1 minute to form a receiving layer so that the thickness of the receiving layer is 10 $\mu$m on a dry basis;

(3) aging the thus obtained receiving material at room temperature for more than 1 day;

(4) superimposing a cyan colored recording material, e.g., Ck2LB used for Mitsubishi Color Video Copy Processor, on the receiving layer of the receiving material and recording an image on the receiving layer by imagewise heating the back side of the recording material using a thermal printhead, e.g., KMT-85-6MPD4 (manufactured by Kyocera Corp.), having a dot density of 6 dots/mm and an average electric resistance of 542 Ω, under a condition of applied energy of 2.00 mJ/dot; and (5) measuring the image density of the recorded image with a Macbeth reflection densitometer RD-918.

A resin whose image density is lower than 1.2 is defined as a resin having relatively low dye receivability in the present invention.

The recording material may include a heat resistant layer, which is formed on the side opposite to the side of the ink layer, to prevent the recording material from sticking to a thermal printhead.

The receiving material of the present invention useful for the n-fold speed mode multiple recording preferably has resistance to sticking. The receiving layer of the receiving material preferably has a degree of gelation of from about 70 to about 99%, and more preferably from about 90 to about 99%, to maintain good resistance to sticking and good thermosensitivity of the receiving material.

The degree of gelation in the present invention is measured and defined as follows:

(1) measuring the coating weight of the receiving layer when the receiving layer is formed;

(2) cutting a sheet of the receiving material 50 mm wide and 100 mm long, and measuring the weight of the sheet;

(3) dipping the sheet into 500 g of methyl ethyl ketone (or a good solvent for the binder resin in the receiving layer) for 10 minutes;

(4) pulling up the sheet from the methyl ethyl ketone and measuring the weight of the sheet after drying the solvent included in the sheet; and (5) obtaining the degree of gelation by the following equation:

$$\text{(degree of gelation)}=\{1-\text{(weight difference between the sheet before dipping and after dipping)}/\text{(coating weight of the receiving layer of 50 mm wide and 100 mm long)}\}\times 100\ (\%)$$

In order to obtain a receiving layer having a desired degree of gelation, known crosslinkable resins or resins which have active hydrogen and can react with an isocyanate compound to form a crosslinked reaction product can be preferably used.

Specific examples of such resins include polyamide, polyethylene, polypropylene, acrylic resins, polyester resins, vinyl chloride-vinyl acetate copolymers, polycarbonate resins, polyurethane resins, epoxy resins, silicone resins, melamine resins, natural rubber, synthetic rubbers, polyvinyl alcohol resins, and cellulose resins. These resins can be employed individually or in combination. In addition, copolymers of these resins can also be employed.

Among these resins, polyester resins and vinyl chloride-vinyl acetate copolymers are preferable because these resins have good dye receivability and can easily produce a crosslinked resin having a proper degree of gelation by reacting with an isocyanate compound in the presence of a catalyst. Specific examples of the polyester resins include Vylon 200, Vylon 300, Vylon 500, GV-110, GV-230, UR-1200, UR-2300, EP-1012, EP-1032, DW-250H, DX-750H and DY-150H, which are manufactured by Toyobo Co., Ltd. Specific examples of the vinyl chloride-vinyl acetate copolymers include VYHH, VYNS, VYHD, VYLF, VMCH, VAGH and VROH, which are manufactured by Union Carbide Corp., and Denka Vinyl #1000A, 1000MT, 1000D, 1000L, 1000CK2 and 1000GKT, which are manufactured by Denki Kagaku Kogyo K.K. Suitable isocyanate compounds for use in the receiving layer include the isocyanate compounds described above for use in the ink layer. The molar ratio of the isocyanate groups in the isocyanate compound included in the receiving layer to hydroxide groups in the resin included in the receiving layer is about 0.1/1 to about 1/1.

In formation of a receiving layer of the present invention, it is preferable to age the receiving layer for a long period of time at a high temperature after the receiving layer is coated and dried so that the degree of gelation of the receiving layer is about 70 to about 99%. The preferred aging temperature is about 50 to about 150° C., and more preferably about 60 to about 100° C. to prevent the receiving material from coloring and curling.

A suitable catalyst for use in the receiving layer of the receiving material of the present invention includes an amine type catalyst such as dimethylmethanolamine, diethylcyclohexylamine, triethylamine, N,N-dimethylpiperazine and triethylenediamine; and a metal-containing catalyst such as, cobalt naphthenate, lead octenate, dibutyl tin dilaurate, stannous chloride, stannic chloride, tetra-n-butyl tin, tri-n-butyl tin acetate, di-n-butyl tin oxide and di-n-octyl tin oxide. Among these catalysts, tin-containing compounds are preferable for use in the receiving layer of the receiving material of the present invention. Specific examples of the tin-containing compounds include TK1L which is manufactured by Takeda Chemical Industries Inc.; and Scat1, Scat1L, Scat8, Scat10, Scat71L and StannBL, which are manufactured by Sankyo Organic Synthesis Co., Ltd. To obtain good heat resistance and good thermosensitivity, the preferred content of the catalyst in the receiving layer is from about 0.05 to about 1.3% by weight.

Up to this point, there has been described a recording method using a thermal printhead as a heating device. However, other sublimation thermal transfer recording methods, using heating devices such as a heat roller, a heat plate or laser, or sublimation thermal transfer recording methods using Joule heat generated in a recording material, can be used. Among these methods, an electrosensitive thermal transfer recording method which has been disclosed, for example, in U.S. Pat. No. 4,103,066 and Japanese Laid-Open Patent Publications No. 57-14060, 57-11080 and 59-9096 is well known.

The electrosensitive thermal transfer recording material useful for the electrosensitive thermal transfer recording method in the present invention is manufactured by, for example, the following methods:

(1) forming, on a substrate, a semiconductive layer which includes a heat resistant resin such as polyester, polycarbonate, triacetyl cellulose, nylon, polyimide and aromatic polyamide, and powder of a metal such as aluminum, copper, iron, tin, nickel, molybdenum and silver which is dispersed in the heat resistant resin, and forming an ink layer including a sublimable dye on the semiconductive layer; or (2) forming a semiconductive layer including powder of the above-mentioned metal described in method (1) on a substrate by an evaporation or a sputtering method and forming an ink layer including a sublimable dye on the semiconductive layer.

The thickness of the substrate is preferably about 2 to about 15 μm in consideration of heat conductive efficiency.

When a laser is used as the heating device of the recording method, a recording material including a substrate which can absorb laser light to generate heat is employed. For example, a recording material having a substrate including carbon or having a laser light absorbing layer which is formed on at least one side of the substrate is preferably employed.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of Recording Materials

The following components were mixed to prepare a yellow ink layer coating liquid.

Formulation of Yellow Ink Layer Coating Liquid

| | |
|---|---|
| Polyvinyl butyral (BX-1, manufactured by Sekisui Chemical Co., Ltd.) | 10 |
| Sublimable dye (Y-2, manufactured by Nippon Kayaku Co., Ltd.) | 5 |
| Toluene | 95 |
| Methyl ethyl ketone | 95 |

The yellow ink coating liquid was coated with a wire bar on an aromatic polyamide film 6 μm thick and dried to form a yellow color recording material having an ink layer 1 μm thick.

The procedure for preparation of the yellow color recording material was repeated to prepare a magenta color recording material and a cyan color recording material except that the sublimable dye was replaced with 5 parts of magenta sublimable dye HM1042 (manufactured by Mitsui Toatsu Dye Chemical Inc.) and 5 parts of cyan sublimable dye HSO271 (manufactured by Mitsui Toatsu Dye Chemical Inc.), respectively.

Thus three color (yellow, magenta and cyan) recording materials were prepared.

Example 2

Preparation of Recording Materials

The procedures for preparation of the yellow, magenta and cyan color recording materials in Example 1 were repeated except that the cyan sublimable dye was replaced with 8 parts of CY-101 (manufactured by Nippon Kayaku Co., Ltd.).

Thus three color recording materials were prepared.

Example 3

Preparation of Recording Materials

The procedures for preparation of the yellow, magenta and cyan color recording materials in Example 1 were repeated except that the magenta sublimable dye was replaced with 10 parts of MACROLEX REDVIOLET R (manufactured by Bayer Ltd.).

Thus three color recording materials were prepared.

Example 4

Preparation of Recording Material

The following components were mixed to prepare a black ink layer coating liquid.

Formulation of Black Ink Layer Coating Liquid

| | |
|---|---|
| Polyvinyl butyral (BX-1, manufactured by Sekisui Chemical Co., Ltd.) | 10 |
| Yellow sublimable dye (Y-2, manufactured by Nippon Kayaku Co., Ltd.) | 3 |
| Magenta sublimable dye (HM1041, manufactured by Mitsui Toatsu Dye Chemical Inc.) | 3 |
| Cyan sublimable dye (HS0271, manufactured by Mitsui Toatsu Dye Chemical Inc.) | 4 |
| Toluene | 95 |
| Methyl ethyl ketone | 95 |

The black ink coating liquid was coated with a wire bar on an aromatic polyamide film 6 μm thick and dried to form a black color recording material having an ink layer 5 μm thick.

Example 5

Preparation of Recording Material

The procedure for preparation of the black recording material in Example 4 was repeated except that the cyan sublimable dye was replaced with 5 parts of CY-101 (manufactured by Nippon Kayaku Co., Ltd.).

Thus a black recording material was prepared.

Example 6

Preparation of Recording Material

The procedure for preparation of the black recording material in Example 4 was repeated except that the magenta sublimable dye was replaced with 5 parts of MACROLEX REDVIOLET R (manufactured by Bayer Ltd.) and the addition quantity of the cyan dye HSO271 was changed to 3 parts.

Thus a black recording material was prepared.

Comparative Example 1

Preparation of Recording Materials

The procedures for preparation of the yellow, magenta and cyan color recording materials in Example 1 were repeated except that the yellow, magenta and cyan sublimable dyes were replaced with 5 parts of Macrolex Yellow 6G (manufactured by Bayer Ltd.), 5 parts of SMS-11 (manufactured by Nippon Kayaku Co., Ltd.) and 5 parts of KP Blue Green FG-S (manufactured by Nippon Kayaku Co., Ltd.), respectively.

Thus three color recording materials were prepared.

Comparative Example 2

Preparation of Recording Materials

The procedures for preparation of the yellow, magenta and cyan color recording materials in Example 1 were repeated except that the yellow, magenta and cyan sublimable dyes were replaced with 5 parts of OPLAS Yellow 140 (manufactured by Arimoto Chemical Co., Ltd.), 5 parts of HM1450 (manufactured by Mitsui Toatsu Dye Chemical Inc.) and 5 parts of HSO-16 (manufactured by Mitsui Toatsu Dye Chemical Inc.), respectively.

Thus three color recording materials were prepared.

Comparative Example 3

Preparation of Recording Material

The procedure for preparation of the black recording material in Example 4 was repeated except that the yellow, magenta and cyan sublimable dyes were replaced with 5 parts of Macrolex Yellow 6G (manufactured by Bayer Ltd.),5 parts of SMS-11 (manufactured by Nippon Kayaku Co., Ltd.) and 5 parts of KP Blue Green FG-S (manufactured by Nippon Kayaku Co., Ltd.), respectively.

Thus a black recording material was prepared.

The recording materials of Examples 1–6 and Comparative Examples 1–3 were evaluated by the following method.

Preparation of Receiving Sheet

The following components were mixed to prepare a receiving layer coating liquid.

Formulation of Receiving Layer Coating Liquid Vinyl chloride-vinyl acetate-vinyl alcohol copolymer 15 (Denka Vinyl 1000GKT, manufactured by Denki Kagaku Kogyo K.K.)

| | |
|---|---|
| Adduct of xylylene diisocyanate (Takenate D-110N, manufactured by Takeda Chemical Industries, Inc.) | 5 |
| Unmodified silicone oil (SH200, manufactured by Toray Silicone Industries, Inc., kinetic viscosity of 1000 cs) | 0.5 |
| Alcohol modified silicone oil (SF8427, manufactured by Toray Silicone Industries, Inc.) | 0.5 |

-continued

| | |
|---|---|
| Toluene | 40 |
| Methyl ethyl ketone | 40 |

The receiving layer coating liquid was coated on a foamed polyester film (W900E, manufactured by Diafoil Corp.) and dried to form a receiving layer 6 μm thick, and then the polyester film having a receiving layer was heated at 60° C. for 50 hours.

Thus a receiving material was prepared.

Evaluation Method

Each recording material was overlaid on the receiving material such that the ink layer of the recording material contacts the receiving layer of the receiving material. By imagewise heating the back side of the recording material with a thermal printhead under the conditions that print energy of the printhead was changed such that the maximum print energy was 2.21 mJ/dot, yellow, magenta, cyan and/or black images were obtained. In the recording materials of Examples 1–3 and Comparative Examples 1 and 2, black images were obtained by overprinting the yellow, magenta and cyan images. The image density of the recorded images was measured with a reflection densitometer, Macbeth RD918 manufactured by Macbeth Co. Images having image density of about 1.0 were subjected to a light irradiation test (light resistant test).

The method of the light resistant test was as follows:

(1) each image having image density of about 1.0 was irradiated with light of 150,000 lux using a Xenon fade meter (manufactured by Shimazu Corp.), for 72 hours;

(2) image density of each image before and after the test was measured; and (3) image density remaining rate was obtained by the following equation:

$$\text{Image density remaining rate (\%)}=(Ia/Ib)\times 100$$

wherein Ia represents the image density after the test and Ib represents the image density before the test.

The results are shown in Table 1.

TABLE 1

| | Image density | Image density remaining rate (%) | | | |
|---|---|---|---|---|---|
| | Black | Yellow | Magenta | Cyan | Black |
| Example 1 | 2.04 | 19 | 33 | 23 | 32 |
| Example 2 | 2.07 | 19 | 33 | 56 | 45 |
| Example 3 | 1.94 | 19 | 72 | 23 | 59 |
| Example 4 | 2.01 | — | — | — | 30 |
| Example 5 | 2.03 | — | — | — | 43 |
| Example 6 | 1.97 | — | — | — | 58 |
| Comparative Example 1 | 2.01 | 73 | 19 | 18 | 20 |
| Comparative Example 2 | 1.53 | 87 | 85 | 87 | 84 |
| Comparative Example 3 | 2.00 | — | — | — | 20 |

The results in Table 1 indicate that the recording material of Examples 1–3 can produce black images having good image density and good light resistance. In particular, the recording material of Example 2 in which the cyan dye has good light resistance can effectively improve the light resistance of the black image. The recording material of Example 3 in which the magenta dye has a violet like color and good light resistance although the cyan dye has a greenish color and relatively low light resistance can also effectively improve the light resistance of the black image.

The results in Table 1 also indicate that the black recording materials of Examples 4–6 can produce black images as good as those of Examples 1–3, and by improving the light resistance of the cyan or the magenta dye, the light resistance of the black image can be effectively improved.

The recording materials of Comparative Examples 1 and 3 can produce black images having good image density but the light resistance of the black images is poor although the light resistance of the yellow dye is excellent.

The recording materials of Comparative Example 2 can produce a black image whose image density is poor.

Examples 7–11

Preparation of Recording Material

The procedure for preparation of the yellow, magenta and cyan recording materials in Example 1 was repeated except that the yellow, magenta and cyan dyes were replaced with the dyes shown in Table 2, respectively.

Thus yellow, magenta and cyan recording materials of Examples 7–11 were prepared.

In Table 2, the dye HSO271 is an indoaniline type dye, and the dye R-3 is an azo dye. In addition, Dye A is an anthraquinone dye, 4-butylamino-8-amino-1, 5-dihydroxyanthraquinone.

Further, "Mitsui" represents Mitsui Toatsu Dye Chemical Inc., and "N. Kayaku" represents Nippon Kayaku Co., Ltd.

TABLE 2

| | Color of dye | Name of dye | Manufacturer | Addition quantity (parts) |
|---|---|---|---|---|
| Example 7 | Yellow | Foron Brilliant Yellow S-6GL | Sandoz Ltd. | 5 |
| | Magenta | R-3 | N. Kayaku | 5 |
| | Cyan | HSO271 | Mitsui | 1 |
| | | Kayaset Blue 714 | N. Kayaku | 4 |
| Example 8 | Yellow | Foron Brilliant Yellow S-6GL | Sandoz Ltd | 5 |
| | Magenta | R-3 | N. Kayaku | 5 |
| | Cyan | HSO271 | Mitsui | 4 |
| | | Kayaset Blue 714 | N. Kayaku | 1 |
| Example 9 | Yellow | Foron Brilliant Yellow S-6GL | Sandoz Ltd. | 5 |
| | Magenta | R-3 | N. Kayaku | 1 |
| | | HSO147 | Mitsui | 4 |
| | Cyan | HSO271 | Mitsui | 4 |
| | | Kayaset Blue 714 | N. Kayaku | 1 |
| Example 10 | Yellow | Foron Brilliant Yellow S-6GL | Sandoz Ltd. | 5 |
| | Magenta | R-3 | N. Kayaku | 4 |
| | | HSO147 | Mitsui | 1 |
| | Cyan | HSO271 | Mitsui | 4 |
| | | Kayaset Blue 714 | N. Kayaku | 1 |
| Example 11 | Yellow | Y-2 | N. Kayaku | 5 |
| | Magenta | R-3 | N. Kayaku | 5 |
| | Cyan | HSO271 | Mitsui | 4 |
| | | Dye A | — | 1 |

The recording materials were evaluated in the same way as performed in Example 1.

The results are shown in Table 3.

TABLE 3

| | Image density remaining rate of black images (%) | Image density | | |
|---|---|---|---|---|
| | | Yellow | Magenta | Cyan |
| Example 7 | 55 | 2.0 | 2.1 | 1.9 |
| Example 8 | 53 | 2.0 | 2.1 | 1.9 |
| Example 9 | 59 | 2.0 | 1.5 | 1.9 |
| Example 10 | 56 | 2.0 | 2.1 | 1.9 |
| Example 11 | 59 | 2.0 | 2.1 | 2.0 |

Although the recording materials of Examples 7 and 8 can produce black images whose image density and light resistance are almost the same, the tint of the cyan image produced by the recording material of Example 8 is better than that produced by the recording material of Example 7. This is because the cyan recording material of Example 8 includes a greater proportion of the indoaniline dye HSO271 than that of Example 7.

Although the recording materials of Examples 9 and 10 can produce black images whose image density and light resistance are almost the same, the image density of the magenta image produced by the recording material of Example 10 is better than that produced by the recording material of Example 9. This is because the magenta recording material of Example 10 includes a greater proportion of the azo dye R-3 than that of Example 9.

The recording material of Example 11 can produce black images whose light resistance is good, because the cyan dye is an anthraquinone dye.

Example 12

Preparation of Receiving Material (2)

The following components were mixed to prepare a receiving layer coating liquid (2).

Formulation of Receiving Mayer Coating Liquid (2)

Vinyl chloride-vinyl acetate-vinyl alcohol copolymer 15 (Denka Vinyl 1000GKT, manufactured by Denki Kagaku Kogyo K.K.)

| | |
|---|---|
| Ultraviolet absorbing agent (SANDVOR VSU, manufactured Sandoz Ltd.) | 1 |
| Adduct of xylylene diisocyanate (Takenate D-110N, manufactured by Takeda Chemical Industries Ltd.) | 5 |
| Unmodified silicone oil (SH200, manufactured by Toray Silicone Industries Inc., kinetic viscosity of 1000 cs) | 0.5 |
| Alcohol modified silicone oil (SF8427, manufactured by Toray Silicone Industries Inc.) | 0.5 |
| Toluene | 40 |
| Methyl ethyl ketone | 40 |

The receiving layer coating liquid (2) was coated on a foamed polyester film (W900E, manufactured by Diafoil Corp.) and dried to form a receiving layer 6 $\mu$m thick, and then the polyester film having a receiving layer was heated at 60° C. for 50 hours. Thus a receiving material (2) was prepared.

The procedures for preparation of the black image in Example 1 were repeated except that the yellow, magenta and cyan recording materials were changed to those of Example 8 and the receiving material was changed to the receiving material (2).

The results are shown in Table 4.

Example 13

Preparation of Receiving Material (3)

The following components were mixed to prepare a receiving layer coating liquid (3).

Formulation of Receiving Layer Coating Liquid (3)

Vinyl chloride-vinyl acetate-vinyl alcohol copolymer 15 (Denka Vinyl 1000GKT, manufactured by Denki Kagaku Kogyo K.K.)

| | |
|---|---|
| Toluene | 40 |
| Methyl ethyl ketone | 40 |

The following components were mixed to prepare a protective layer coating liquid.

Formulation of Protective Layer Coating Liquid

| | |
|---|---|
| Silicone resin (SR2411, manufactured by Toray Silicone Industries Inc.) | 15 |
| Acryl-silicone block copolymer (LD500, manufactured by Natoco Paint Co., Ltd.) | 0.5 |
| 2-propanol | 85.5 |
| Ultraviolet absorbing agent | 0.5 |

(SANDVOR VSU, manufactured by Sandoz Ltd.)

The receiving layer coating liquid (3) was coated on a foamed polyester film (W900E, manufactured by Diafoil Ltd) and dried to form a receiving layer 5 μm thick, and then the protective layer coating liquid was coated thereon and dried to form a protective layer 1 μm thick, and further the polyester film having a receiving layer and a protective layer was heated at 60° C. for 50 hours. Thus a receiving material (3) of the present invention was prepared.

The procedures for formation and evaluation of the black image in Example 12 were repeated except that the receiving material was replaced with the receiving material (3).

The results are shown in Table 4.

Example 14

The procedures for preparation and evaluation of the black image in Example 13 were repeated except that the black image was heated at 90° C. for 10 seconds under a pressure of 10 g/cm$^2$.

The results are shown in Table 4.

TABLE 4

| | Light resistance of black image |
|---|---|
| Example 8 | 53 |
| Example 12 | 62 |
| Example 13 | 71 |
| Example 14 | 84 |

The results in Table 4 indicate that the black images obtained in Examples 12–14 have good light resistance. The black image obtained in Example 13 has better light resistance than that in Example 12 because the protective layer through which a dye can penetrate is formed on the dye receiving layer. Further, the black image obtained in Example 14 has the best light resistance among the black images in Table 4 because the dye image is diffused into the dye receiving layer.

Example 15

Preparation of Receiving Material

The procedure for preparation of the receiving material in Example 13 was repeated to prepare a receiving material (3).

Preparation of Recording Material

The following components were mixed to prepare an adhesive layer coating liquid.

Formulation of Adhesive Layer Coating Liquid

| | |
|---|---|
| Polyvinyl butyral (BX-1, manufactured by Sekisui Chemical Co., Ltd.) | 10 |
| Isocyanate compound (Colonate L, manufactured by Nippon Polyurethane Industry Co., Ltd.) | 5 |
| Toluene | 95 |
| Methyl ethyl ketone | 95 |

The following components were mixed to prepare a yellow dye supplying layer coating liquid. In addition, this procedure was repeated to prepare magenta and cyan dye supplying layer coating liquids except that the yellow dye was replaced with 20 parts of a magenta dye, R-3, manufactured by Nippon Kayaku Co., Ltd. and 20 parts of a cyan dye mixture (16 parts of HSO271, manufactured by Mitsui Toatsu Dye Chemical Inc. and 4 parts of Dye A (4-butylamino-8-amino-1, 5-dihydroxyanthraquinone)), respectively.

Formulation of Dye Supplying Layer Coating Liquid

| | |
|---|---|
| Polyvinyl butyral (BX-1, manufactured by Sekisui Chemical Co., Ltd.) | 10 |
| Yellow sublimable dye (Foron Brilliant Yellow S-6GL, manufactured by Sandoz Ltd.) | 20 |
| Ethanol | 180 |
| n-butanol | 10 |

Formulation of Coating Liquid for Resin Layer Having Relatively Low Dye Receivability

| | |
|---|---|
| Styrene-maleic acid copolymer (Suprapearl AP-30, manufactured by BASF Ltd.) | 10 |
| Liquid B | 12 |
| Tetrahydrofuran | 20 |
| Methyl ethyl ketone | 95 |

The liquid B was prepared by dissolving 15 g of dimethyl methoxy silane and 9 g of methyl trimethoxy silane in a mixture of 12 g of toluene and 12 g of methyl ethyl ketone, and then hydrolyzing for 3 hours after 13 ml of sulfuric acid was added in the mixture thereof.

The adhesive layer coating liquid was coated with a wire bar on one side of an aromatic polyamide film 6 μm thick, which had a heat resistant silicone resin layer 1 μm thick on the other (back) side, and dried and then aged at 60° C. for 12 hours to form an adhesive layer 1 μm thick. The yellow, the magenta and the cyan dye supplying layer coating liquids were coated, dried and aged in the same way as performed in forming the adhesive layer such that yellow, magenta and cyan dye supplying layers were regularly formed on the adhesive layer, i.e. in succession in a longitudinal direction of the aromatic polyamide film. Thus yellow, magenta and cyan dye supplying layers each having thickness of 3 μm were prepared. Further, on the dye supplying layers, a coating liquid for a resin layer having relatively low dye receivability was coated, dried and aged in the same way as performed in forming the adhesive layer to form a resin layer 1 μm thick. Thus a recording material was prepared.

The recording material was overlaid on the receiving material (3) such that the resin layer having relatively low dye receivability of the recording material contacted the ultraviolet absorbing layer of the receiving material, and black images were recorded with a thermal printhead on the receiving material by superimposing a yellow, a magenta and a cyan image using an n-fold multiple sublimation thermal transfer recording. The recording conditions were as follows:

| | |
|---|---|
| Maximum print energy of the thermal printhead | 2.21 mJ/dot |
| Feeding speed of the receiving material | 8.0 mm/sec |
| Feeding speed of the recording material | 0.8 mm/sec |

Thus black images were obtained, and then evaluated in the same way as performed in Example 1.

The results are shown in Table 5.

Example 16

The procedure for preparation of the black images in Example 15 was repeated to obtain black images.

Formation of Sheet Useful for Heating Images

The procedure for preparation of the aromatic polyamide film having an adhesive layer in Example 15 was repeated. Then the following lubricating layer coating liquid was coated on the adhesive layer and dried and then aged at 60° C. for 12 hours to form a lubricating layer 1 μm thick.

Thus a sheet useful for heating images was prepared.

Formulation of Lubricating Layer Coating Liquid

| | |
|---|---|
| Styrene-maleic acid copolymer (Suprapearl AP-30, manufactured by BASF Ltd.) | 10 |
| Liquid B | 12 |
| Tetrahydrofuran | 20 |
| Methyl ethyl ketone | 95 |

The sheet was overlaid on the black images formed on the receiving material such that the lubricating layer contacted the black images, and then the sheet was heated with a thermal printhead to heat the black images. The heating conditions were as follows:

| | |
|---|---|
| Maximum heat energy of the thermal printhead | 2.21 mJ/dot |
| Feeding speed of the receiving material | 8.0 mm/sec |
| Feeding speed of the sheet | 0.8 mm/sec |

The heated black images were evaluated in the same way as performed in Example 1.

The results are shown in Table 5.

Example 17

The procedures for preparation and evaluation of black images in Example 16 were repeated except that the maximum heat energy of the thermal printhead for heating the black image was changed to 2.0 mJ/dot.

The results are shown in Table 5.

TABLE 5

| | Light resistance of black image (image density remaining rate) (%) |
|---|---|
| Example 15 | 72 |
| Example 16 | 86 |
| Example 17 | 88 |

As can be understood from the Table 5, black images having good light resistance can be obtained at low running cost because n-fold multiple sublimation thermal transfer recording is used for recording the black images. In particular, the black images obtained in Examples 16 and 17 have excellent light resistance.

Additional modifications and variations of the present invention are possible in light of the above teachings. It is therefore to be understood that within the scope of the appended claims the invention may be practiced other than as specifically described herein.

This application is based on Japanese Patent Application No. 09-309354, filed on Oct. 23, 1997, the entire contents of which are herein incorporated by reference.

What is claimed is:

1. A sublimation thermal transfer recording material comprising a substrate and one or more ink layers which are formed on one side of the substrate and which comprise at least a yellow sublimable dye, a magenta sublimable dye and a cyan sublimable dye to form at least a black color image on a receiving material, wherein the magenta and the cyan sublimable dye have better light resistance than the yellow sublimable dye.

2. The sublimation thermal transfer recording material according to claim 1, wherein the recording material comprises at least three inlayers and wherein the ink layers are successively formed on the substrate side-by-side in a longitudinal direction of the substrate and respectively comprise the yellow sublimable dye, the magenta sublimable dye and the cyan sublimable dye.

3. The sublimation thermal transfer recording material according to claim 2, wherein the recording material further comprises a no-ink area on the side of the substrate on which the ink layer or layers are formed and wherein the no-ink area and the ink layer or layers are successively formed on the substrate side-by-side in a longitudinal direction of the substrate.

4. The sublimation thermal transfer recording material according to claim 1, wherein the recording material comprises one ink layer, and wherein the one ink layer comprises the yellow sublimable dye, the magenta sublimable dye and the cyan sublimable dye.

5. The sublimation thermal transfer recording material according to claim 4, wherein the recording material further comprises a no-ink area on the side of the substrate on which the ink layer is formed, and wherein the no-ink area and the ink layer are successively formed on the substrate side-by-side in a longitudinal direction of the substrate.

6. The sublimation thermal transfer recording material according to claim 1, wherein the cyan sublimable dye has better light resistance than the magenta sublimable dye.

7. The sublimation thermal transfer recording material according to claim 1, wherein the cyan sublimable dye comprises an indoaniline dye and an anthraquinone dye.

8. The sublimation thermal transfer recording material according to claim 7, wherein the indoaniline sublimable dye is present in the ink layer in an amount greater than that of the anthraquinone dye.

9. The sublimation thermal transfer recording material according to claim 7, wherein the anthraquinone dye comprises 4-butylamino-8-amino-1, 5-dihydroxyanthraquinone.

10. The sublimation thermal transfer recording material according to claim 1, wherein the magenta sublimable dye comprises an azo dye and an anthraquinone dye.

11. The sublimation thermal transfer recording material according to claim 10, wherein the azo sublimable dye is present in the ink layer in an amount greater than that of the anthraquinone dye.

12. A sublimation thermal transfer recording method comprising the steps of:

providing a sublimation thermal transfer recording material which comprises a substrate and one or plural ink layers which are formed on one side of the substrate, said one ink layer comprising at least a yellow, a magenta and a cyan sublimable dye or said plural ink layers respectively comprising at least a yellow, a magenta and a cyan sublimable dye, wherein the magenta and the cyan sublimable dyes have better light resistance than the yellow sublimable dye; and a sublimation thermal transfer receiving material which comprises a receiving layer which comprises an ultraviolet absorbing agent in an upper part thereof or on which a protective layer comprising an ultraviolet absorbing agent is formed;

imagewise heating the recording material while the ink layer or one of the plural ink layers contacts the image receiving layer or the protective layer to form a dye image on the image receiving layer or the protective layer and, if plural ink layers are present, repeating the imagewise heating using the other plural ink layers one by one, to form at least a black dye image on the receiving material;

separating the receiving material from the recording material; and then heating the receiving material having the black dye image to diffuse the black image into the inside of the image receiving layer.

13. The sublimation thermal transfer recording method according to claim 12, wherein the imagewise heating is performed while the recording material is fed at a speed slower than that of the image receiving material.

14. The sublimation thermal transfer recording method according to claim 12, wherein the heating comprises the substeps of:

overlaying the image receiving material having the black dye image with a sheet such that the sheet contacts the black dye image; and heating the sheet to diffuse the black dye image into the inside of the image receiving layer.

15. The sublimation thermal transfer recording method according to claim 14, wherein the heating is performed while the sheet is fed at a speed slower than that of the image receiving material.

16. The sublimation thermal transfer recording method according to claim 12, wherein the recording material further comprises a no-ink area on the side of the substrate on which the ink layer or layers are formed, and wherein the heating of the image is performed while the image contacts the no-ink area of the recording material.

17. A sublimation thermal transfer recording method comprising the steps of:

providing sublimation thermal transfer recording materials each of which comprises a substrate and at least one ink layer which is formed on one side of the substrate and which comprises at least a sublimable dye, wherein at least a yellow, a magenta and a cyan sublimable dyes are included in the ink layers of the recording materials, and wherein the magenta and the cyan sublimable dyes have better light resistance than the yellow sublimable dye; and a sublimation thermal transfer receiving material which comprises a receiving layer which comprises an ultraviolet absorbing agent in an upper part thereof or on which a protective layer comprising an ultraviolet absorbing agent is formed;

imagewise heating one of the recording materials while one of the ink layers contacts the image receiving layer or the protective layer to form a dye image on the image receiving layer;

repeating the imagewise heating using the other recording material or materials one by one to form at least a black image on the receiving material;

separating the receiving material from the recording material; and then heating the receiving material having the black dye image to diffuse the black image into the inside of the image receiving layer.

18. The sublimation thermal transfer recording method according to claim 17, wherein the imagewise heating is performed while the recording material is fed at a speed slower than that of the image receiving material.

* * * * *